US010086493B2

(12) United States Patent
Matsui et al.

(10) Patent No.: US 10,086,493 B2
(45) Date of Patent: Oct. 2, 2018

(54) METHOD FOR PRODUCING SUBSTRATES

(71) Applicant: Shin-Etsu Chemical Co., Ltd., Tokyo (JP)

(72) Inventors: Harunobu Matsui, Joetsu (JP); Daijitsu Harada, Joetsu (JP); Masaki Takeuchi, Joetsu (JP)

(73) Assignee: SHIN-ETSU CHEMICAL CO., LTD., Tokyo (JP)

( * ) Notice: Subject to any disclaimer, the term of this patent is extended or adjusted under 35 U.S.C. 154(b) by 39 days.

(21) Appl. No.: 15/153,327

(22) Filed: May 12, 2016

(65) Prior Publication Data

US 2016/0332280 A1 Nov. 17, 2016

(30) Foreign Application Priority Data

May 13, 2015 (JP) ..... 2015-098267
Jun. 5, 2015 (JP) ..... 2015-114759

(51) Int. Cl.
*B24B 37/10* (2012.01)
*B24B 7/24* (2006.01)
(Continued)

(52) U.S. Cl.
CPC ..... *B24B 37/10* (2013.01); *B24B 7/228* (2013.01); *B24B 7/241* (2013.01); *B24B 37/042* (2013.01); *B24B 37/08* (2013.01)

(58) Field of Classification Search
CPC ..... B24B 7/228; B24B 7/241; B24B 37/022; B24B 37/042; B24B 37/044; B24B 37/08; B24B 37/28
See application file for complete search history.

(56) References Cited

U.S. PATENT DOCUMENTS 5,645,472 A * 7/1997 Nagahashi ..... B24B 7/17 451/261
5,967,882 A 10/1999 Duescher
(Continued)

FOREIGN PATENT DOCUMENTS

EP 2 189 240 A1 5/2010
JP 9-109021 A 4/1997
(Continued)

OTHER PUBLICATIONS

Extended European Search Report for Appl. No. 16169066.4 dated Oct. 12, 2016.
(Continued)

*Primary Examiner* — Timothy V Eley
(74) *Attorney, Agent, or Firm* — Birch, Stewart, Kolasch & Birch, LLP

(57) ABSTRACT

Proposed herein is a method for producing substrates, particularly those of synthetic quartz glass, while saving the substrate surface from killer defects without resorting to any large-scale apparatus and precision polishing plate, thereby reducing defects and improving yields more than in production with conventional facilities. The method for producing substrates by polishing, includes steps of placing substrate stocks individually in work holes formed in a carrier on a lower polishing plate, bringing an upper polishing plate into contact with the surface of the substrate stocks, with the surface of the substrate stocks being coated with an impact-absorbing liquid and the lower polishing plate being rotated, and rotating the upper and lower polishing plates, with the surface of the substrate stocks being accompanied by a polishing slurry.

15 Claims, 1 Drawing Sheet

(51) Int. Cl.

| | |
|---|---|
| ***B24B 37/04*** | (2012.01) |
| ***B24B 37/08*** | (2012.01) |
| ***B24B 7/22*** | (2006.01) |

(56) References Cited

U.S. PATENT DOCUMENTS

| | | | | |
|---|---|---|---|---|
| 6,645,862 | B2 * | 11/2003 | Wenski | B24B 37/0056 257/E21.23 |
| 2004/0038544 | A1 * | 2/2004 | Zhang | B24B 37/08 438/709 |
| 2004/0082279 | A1 * | 4/2004 | Asahina | B24B 37/044 451/41 |
| 2005/0064796 | A1 | 3/2005 | Minamihaba et al. | |
| 2010/0009155 | A1 | 1/2010 | Hashii et al. | |
| 2011/0204024 | A1 | 8/2011 | Moriya | |
| 2012/0204603 | A1 * | 8/2012 | Haneda | C09K 3/1409 65/31 |
| 2012/0315739 | A1 | 12/2012 | Hashii et al. | |
| 2013/0316521 | A1 * | 11/2013 | Sasaki | B24B 37/08 438/478 |

FOREIGN PATENT DOCUMENTS

| | | | |
|---|---|---|---|
| JP | 2006-061995 | A | 3/2006 |
| JP | 2008-101132 | A | 5/2008 |
| JP | 2011-000644 | A | 1/2011 |
| JP | 2012-192486 | A | 10/2012 |

OTHER PUBLICATIONS

Office Action issued in corresponding Japanese Application No. 2015-114759 dated Apr. 3, 2018.

* cited by examiner

METHOD FOR PRODUCING SUBSTRATES

CROSS-REFERENCE TO RELATED APPLICATION

This non-provisional application claims priority under 35 U.S.C. § 119(a) on Patent Application Nos. 2015-098267 and 2015-114759 filed in Japan on May 13, 2015 and Jun. 5, 2015, respectively, the entire contents of which are hereby incorporated by reference.

TECHNICAL FIELD

The present invention relates to a method for producing substrates of synthetic quartz glass to be employed in high-tech industry covering especially photomasks, optical sensors, sequencer chips, etc.

BACKGROUND ART

Precision instruments are incorporated with such devices as semiconductor integrated circuits which are produced by the process involving optical lithography or nano-imprinting. This process is strongly required to yield a substrate free of defects as much as possible on its surface. Any defect on a masking substrate, for example, to be used as an original plate for exposure in photolithography, would be transferred to cause defective patterning.

The above-mentioned substrate varies in thickness depending on its uses. Usually, it may be as thin as about 0.1 to 1.0 mm if it is intended for complementary metal-oxide semiconductor (CMOS) sensors, light waveguide sensors, sequencer chips, etc. Such thin substrates, glasses used in DNA sequencer chips for example, are conventionally produced by forming a pattern on one side of a thick substrate and grinding the reverse side subsequently. This conventional process consisting of patterning and ensuing grinding has a disadvantage that the substrate is liable to break as the patterning becomes more intricate than before with generation change. One way under development to overcome this disadvantage is by patterning on an originally thin substrate.

Production of those substrates for photomasks and optical sensors usually involves several steps, such as lapping and polishing, to prepare the surface with a high degree of flatness and a minimum of defects.

A substrate of synthetic quartz glass suffers impact during lapping and polishing, with the magnitude of impact varying between them. Lapping gives rise to a much more significant impact than polishing, because lapping usually employs a lapping plate of cast iron, which is much harder than the substrate, and the lapping plate comes into direct contact with the substrate. By contrast, polishing only causes insignificant impact, because polishing employs a polishing cloth, which is softer than the substrate.

In order to minimize defects caused by impact on the substrate surface, there have been proposed several methods for applying the lapping plate onto the substrate in the lapping step.

An example of such methods, disclosed in JP-A 2012-192486 (Patent Document 1), consists of pressing the polishing plate against the substrate by means of hydraulic pressure instead of conventional pneumatic pressure. The hydraulic pressure is exempted from the irregular pressure fluctuation characteristic of air stream, and hence it does not apply any uneven pressure to the substrate when the polishing plate comes into contact with the substrate and while polishing is performed. Thus, the disclosed method permits any thin workpiece to be fabricated without damage.

Another example of methods, disclosed in JP-A H09-109021 (Patent Document 2), consists of employing a suction pad that levels warpage on the substrate surface to be polished, and also employing a highly rigid polishing plate with minimum warpage, thereby keeping uniform the pressure applied to the surface being polished. Thus, the disclosed method is able to prevent uneven pressure from occurring in the substrate surface when the polishing plate comes into contact with the substrate and while polishing is performed.

CITATION LIST

Patent Document 1: JP-A 2012-192486
Patent Document 2: JP-A H09-109021

DISCLOSURE OF INVENTION

However, the method disclosed in Patent Document 1 seems to be unsatisfactory in completely avoiding irregular pressure fluctuation when the polishing plate comes into contact with the substrate surface and while polishing is performed, because it is designed to control pressure by means of liquid like water current.

Moreover, the method disclosed in Patent Document 2 is likely to cause cracking to the substrate (especially a thin one) at the time of warpage correction because it uses suction to correct the substrate shape. In addition, it is practically unable to completely eliminate non-uniformity in the surface under the polishing pressure and hence is liable to cause killer defects to the substrate surface even though it employs a nearly undeformable polishing plate. It has another disadvantage that any precision polishing plate will cost much and need a long time to prepare.

Thus, it is an object of the present invention to provide a method for producing substrates, particularly those of synthetic quartz glass, while saving the substrate surface from killer defects without resorting to any large-scale apparatus and precision polishing plate, thereby reducing defectives and improving yields more than in production with conventional facilities.

In order to tackle the above-mentioned problems, the present inventors conducted investigations while focusing on the landing of the polishing plate at the time of substrate fabrication. As a result, it was found that the object is favorably achieved if the upper polishing plate is brought into contact with the substrate surface while the lower polishing plate (which supports the substrate coated with an impact-absorbing liquid) is being rotated. This method helps produce substrates of any size (particularly thin ones) free of the surface defects which are liable to occur at the time of contact between the polishing plate and the substrate surface.

Thus, the present invention provides a method for producing substrates as defined below.

[1] A method for producing substrates by polishing, includes steps of placing substrate stocks individually in work holes formed in a carrier on a lower polishing plate, bringing an upper polishing plate into contact with the surface of the substrate stocks, with the surface of the substrate stocks being coated with an impact-absorbing liquid and the lower polishing plate being rotated, and rotating the upper and lower polishing plates, with the surface of the substrate stocks being accompanied by a polishing slurry.

[2] The method for producing substrates of [1], wherein the upper polishing plate is brought into contact with the surface of the substrate stocks, with the lower polishing plate rotating at 1 rpm to 4 rpm.

[3] The method for producing substrates of [1] or [2], wherein the impact-absorbing liquid is an aqueous solution containing at least one species selected from glycols, polyacrylic acid and derivatives thereof, poly(meth)acrylic acid and derivatives thereof, diethanolamine, and triethanolamine.

[4] The method for producing substrates of any one of [1] to [3], wherein the impact-absorbing liquid has a viscosity of 10 mPa·s to 100 mPa·s at 20° C.

[5] The method for producing substrates of any one of [1] to [4], wherein the upper polishing plate is lowered at a rate of 5 mm/second to 20 mm/second until it comes into contact with the surface of substrate stocks.

[6] The method for producing substrates of any one of [1] to [5], wherein the polishing slurry is an aqueous dispersion containing at least one species of abrasive grains selected from the group consisting of alumina abrasive grains, silicon carbide abrasive grains, and zirconium oxide abrasive gains.

[7] The method for producing substrates of any one of [1] to [6], wherein the substrate stocks have a thickness of 0.1 mm to 7 mm before polishing.

[8] The method for producing substrates of any one of [1] to [7], wherein the substrate stocks are synthetic quartz glass.

[9] The method for producing substrates of any one of [1] to [8], wherein said polishing step corresponds to a lapping step.

Advantageous Effects of the Invention

The present invention offers an advantage over the conventional processing method that it reduces the possibility of damages (such as cracking) occurring on the surface of substrate stocks when the upper polishing plate comes into contact with the surface of substrate stocks. Moreover, the method of the present invention does not need any additional steps for protecting the surface of substrate stocks from cracking when the upper polishing plate comes into contact with the surface of substrate stocks. Consequently, the present invention not only improves yields and productivity but also effectively utilizes the existing facilities without a large amount of investment.

DESCRIPTION OF THE PREFERRED EMBODIMENTS

Figure 1:
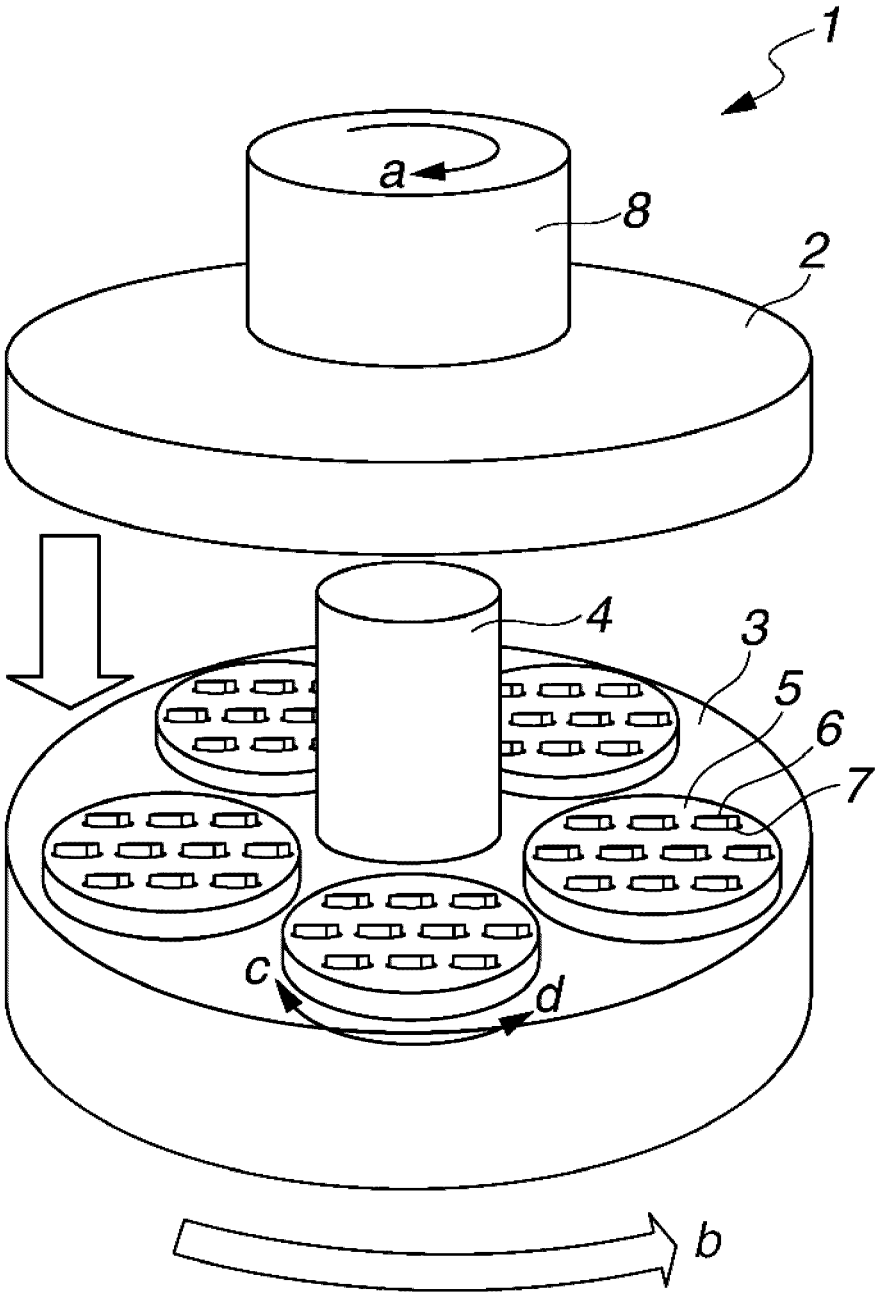
FIG. 1 is a schematic diagram showing one example of a both sides polishing apparatus used in examples of the present invention.

The present invention will be described below with reference to the accompanying drawing.

According to the present invention, the method for producing substrates by polishing includes steps of placing substrate stocks individually in work holes formed in a carrier on a lower polishing plate, bringing an upper polishing plate into contact with the surface of the substrate stocks, with the surface of the substrate stocks (in the work holes) being coated with an impact-absorbing liquid and the lower polishing plate being rotated, so that the upper polishing plate gently comes into contact with the surface of substrate stocks, with the amount of touching force reduced.

According to the present invention, the method for producing substrates may be applied by employing a both sides polishing apparatus shown in FIG. 1. A polishing apparatus 1 includes an upper polishing plate 2 capable of vertical movement, a lower polishing plate 3 facing the upper polishing plate 2, and a plurality of carriers 5 arranged at equal intervals around a rotating shaft 4 of the lower polishing plate 3. Each carrier has a plurality of work holes 7 which hold substrate stocks (works) 6. Each work hole holds one substrate stock. The carrier is thinner than the substrate stocks, so that the substrate stocks 6 are polished as the upper polishing plate 2 moves downward to hold the substrate stocks between the upper polishing plate 2 and the lower polishing plate 3 and the upper polishing plate 2 is rotated in the direction of arrow a (at a prescribed speed) around a rotating shaft 8 thereof and the lower polishing plate 3 is rotated in the direction of arrow b around the rotating shaft 4 of the lower polishing plate 3 and the carrier 5 is rotated in the direction of arrow c or arrow d, with a polishing slurry (not shown) being supplied to the interface between the upper polishing plate 2 and the substrate stocks 6.

If the upper polishing plate is brought downward vertically into contact with the substrate stocks held in the work holes in the carrier on the lower polishing plate which remains stationary, then the substrate stocks receive a force having only one vertical component. This force, if excessively large, will damage the surface of the substrate stocks when the upper polishing plate comes into contact with the surface of the substrate stocks.

However, in the case where the lower polishing plate is rotating when the upper polishing plate comes into contact with the surface of the substrate stocks held in the work holes on the lower polishing plate, the surface of the substrate stocks receives a resultant force composed of vertical component (due to downward motion of the upper polishing plate) and horizontal component (due to the rotation of the lower polishing plate). In other words, the resultant vector applied to the substrate stocks at the time of contact with the upper polishing plate is inclined toward the horizontal direction from the vertical direction with respect to the substrate stocks. Thus, it is possible to reduce the vertical force largely responsible for serious damages to the substrate stocks.

Moreover, application of an impact-absorbing liquid onto the surface of substrate stocks in advance protects the substrate stocks from impact in the vertical direction that occurs when the upper polishing plate comes into contact with the surface of substrate stocks. This step may be accomplished by placing substrate stocks in a vessel holding an impact-absorbing liquid or by spraying the substrate stocks (held in the working carrier) with an impact-absorbing liquid.

The thus applied impact-absorbing liquid reduces various defects which would otherwise occur on the surface of substrate stocks. Such defects include crow's track, macroscratch, etc. defined in Japanese Industrial Standards (JIS) H 0614.

The impact-absorbing liquid becomes irregular in coating thickness due to surface tension as time goes on after its application onto the surface of substrate stocks. However, the coating thickness remains uniform if the lower polishing plate is rotated so that a force in the horizontal direction is applied to the liquid coating on the surface of substrate stocks. Also, the rotation of the lower polishing plate protects the substrate stocks from irregular pressure which is applied by the upper polishing plate when the upper polishing plate comes into contact with the substrate stocks.

The impact-absorbing liquid should preferably be an aqueous liquid containing at least one species selected from glycols such as ethylene glycol, propylene glycol, polyethylene glycol, and polypropylene glycol; polyacrylic acid and derivatives thereof such as polyacrylic acid and sodium polyacrylate: poly(meth)acrylic acid and derivatives thereof such as poly(meth)acrylic acid and sodium poly(meth)acrylate; diethanolamine, and triethanolamine.

The impact-absorbing liquid should have a viscosity of 10 mPa·s to 100 mPa·s, preferably 10 mPa·s to 70 mPa·s, more preferably 20 mPa·s to 50 mPa·s, at 20° C. This requirement is set so that the impact-absorbing liquid freely flows and evenly spreads over the surface of substrate stocks, thereby effectively avoiding irregular pressure applied by the upper polishing plate. In the present invention, the above-mentioned viscosity may be measured by using a viscometer Model TVC-7, made by Toki Sangyo Co., Ltd.

While the upper polishing plate is coming into contact with the surface of substrate stocks, the lower polishing plate should rotate at 1 rpm to 4 rpm, preferably 2 rpm to 4 rpm, so that damages to the substrate stocks are minimal. The direction of rotation is not specifically restricted. It is desirable that the upper and lower polishing plates should turn oppositely to each other, so that the upper polishing plate rotates at a high horizontal speed relative to the surface of substrate stocks and the surface of substrate stocks receives a force in the direction inclined toward the horizontal due to the combination of the vertical force applied by the upper polishing plate and the horizontal force applied by the rotating substrate stocks.

The upper polishing plate should be lowered at a speed of 5 mm/second to 20 mm/second, preferably 5 mm/second to 15 mm/second, more preferably 5 mm/second to 10 mm/second, in consideration of damages to the substrate stocks and evaporation of the impact-absorbing liquid.

After the upper polishing plate has come into contact with the surface of substrate stocks, polishing may be accomplished under ordinary conditions for the rotational speed and polishing pressure of the upper and lower polishing plates.

The polishing slurry to be applied to the surface of substrate stocks at the time of polishing should contain abrasive grains selected from those of alumina, silicon carbide, and zirconium oxide. Such abrasive grains should have a primary particle diameter in the range of 0.5 μm to 50 μm, preferably 0.5 μm to 30 μm, more preferably 0.5 μm to 10 μm. This requirement is set in consideration of the vulnerability of the substrate surface to damages caused by polishing. Incidentally, the particle diameter of the abrasive grains may be determined by using the zeta potential and particle diameter measuring system, ELSZ-1000ZS, made by Otsuka Electronics Co., Ltd.

The abrasive grain may be commercial one or may be used in the form of aqueous dispersion (in pure water) of solid abrasive grains. An example of alumina abrasive grain is that of FO series available from Fujimi Incorporated. An example of silicon carbide abrasive grain is that of GP series and GC series available from Shinano Electric Refining Co., Ltd. and Fujimi Incorporated, respectively. An example of zirconium oxide abrasive grain is that of MZ series, DK-3CH series, and FSD series available from Daiichi Kigenso Kagaku Kogyo Co., Ltd.

The method of the present invention should preferably be applied to production of substrates from synthetic quartz glass. Such substrates may be obtained through the steps of ingoting synthetic quartz glass, annealing, slicing, edging, lapping, and polishing both sides for mirror finish. The method of the present invention may also be applied to production of substrates from soda lime glass, silicon wafer, sapphire, gallium nitride, lithium tantalite, etc. by the same steps as mentioned above.

The method of the present invention may be applied to any substrate without specific restrictions on its size and thickness. It produces its maximum effect when applied to thin substrates with a thickness ranging from 0.1 mm to 7 mm, preferably 0.1 mm to 1 mm. Although thin substrates are usually vulnerable to damages to their surface during processing, especially due to impacts that occur when the upper polishing plate comes into contact with substrates, it is possible to avoid such damages, thereby remarkably reducing the level of defectiveness, with the method of the present invention.

The substrate to be fabricated by the method of the present invention may be square or circular in shape. Square substrates measure 6-inch square and 6.35 mm in thickness (corresponding to 6025 substrate), 6-inch square and 2.3 mm in thickness (corresponding to 6009 substrate), 6-inch square and 0.35 mm in thickness, and 400 mm-square and 1.0 mm in thickness. Circular substrates (in the form of wafer) measure 6 inches, 8 inches, and 12 inches in diameter, with a thickness ranging from 0.1 mm to 0.5 mm. These substrate stocks are suitable for polishing by the method of the present invention.

The method of the present invention may be applied usually to the batch-wise polishing of both sides. However, it may also be applied to the polishing of single side in the sheet-fed mode. Either way of polishing includes the step of bringing the polishing plate into contact with the substrate stocks.

EXAMPLES

The present invention will be described below to demonstrate its effect with reference to Working Examples and Comparative Examples, which are not intended to restrict the scope thereof.

Working Examples 1 to 6

Polishing was performed as follows on the substrate stocks of synthetic quartz glass (8 inches in diameter and 0.3 mm in thickness) which are held in the work hole shown in FIG. 1. The upper polishing plate was brought into contact with the substrate stocks, while the lower polishing plate was rotating, under the conditions shown in Table 1. The substrate stocks had their surface coated with an impact-absorbing liquid, which is an aqueous solution of ethylene glycol having a viscosity of 18 mPa·s at 20° C. The upper polishing plate in contact with the surface of the substrate stocks was rotated, with the interface between the substrate surface and the upper polishing plate being supplied with a slurry composed of pure water and silicon carbide abrasive grains called "Shinanorundum GP #4000," made by Shinano Electric Refining Co., Ltd. In each example, hundred pieces of substrate stocks underwent polishing. After polishing, the specimens were examined for flaws to count the percent defective. Any specimen was regarded as defective if it has on its surface one or more flaws (such as crow's track and macroscratch) defined in JIS H 0614.

Incidentally, polishing was performed by using a polishing machine, "16BF for two-side polishing" available from Hamai Co., Ltd.

TABLE 1

| Working Example No. | Descending speed of upper polishing plate (mm/second) | Rotating speed of lower polishing plate (rpm) | Percent defective after polishing (%) |
|---|---|---|---|
| 1 | 5.0 | 1 | 0 |
| 2 | 5.0 | 4 | 0 |
| 3 | 7.0 | 1 | 2 |
| 4 | 7.0 | 4 | 0 |
| 5 | 10.0 | 1 | 3 |
| 6 | 10.0 | 4 | 0 |

Comparative Examples 1 to 3

Polishing was performed under the conditions shown in Table 2 in the same way as in Working Examples 1 to 6 except that the lower polishing plate remained stationary. The results of examination are shown in Table 2.

TABLE 2

| Comparative Example No. | Descending speed of upper polishing plate (mm/second) | Rotating speed of lower polishing plate (rpm) | Percent defective after polishing (%) |
|---|---|---|---|
| 1 | 5.0 | 0 | 22 |
| 2 | 7.0 | 0 | 25 |
| 3 | 10.0 | 0 | 37 |

Comparative Examples 4 and 5

Polishing was performed under the conditions shown in Table 3 in the same way as in Working Examples 1 to 6 except that the impact-absorbing liquid was not applied to the surface of the substrate stocks. The results of examination are shown in Table 3.

TABLE 3

| Comparative Example No. | Descending speed of upper polishing plate (mm/second) | Rotating speed of lower polishing plate (rpm) | Percent defective after polishing (%) |
|---|---|---|---|
| 4 | 7.0 | 1 | 35 |
| 5 | 7.0 | 4 | 15 |

Working Examples 7 to 9

Polishing was performed as follows on the substrate stocks of synthetic quartz glass (6-inch square and 6.35 mm in thickness) which are held in the work hole shown in FIG. 1. The upper polishing plate was brought into contact with the substrate stocks, while the lower polishing plate was rotating, under the conditions shown in Table 4. The substrate stocks had their surface coated with an impact-absorbing liquid, which is an aqueous solution containing propylene glycol and diethanolamine in a ratio of 10:1 (by weight) such that it has a viscosity of 40 mPa·s at 20° C. The upper polishing plate in contact with the surface of the substrate stocks was rotated, with the interface between the substrate surface and the upper polishing plate being supplied with a slurry composed of pure water and alumina abrasive grains called "FO #2000," made by Fujimi Incorporated Co., Ltd. The substrate stocks underwent polishing in the same way as in Working Examples 1 to 6. The finished specimens were examined for flaws. The results of examination are shown in Table 4.

TABLE 4

| Working Example No. | Descending speed of upper polishing plate (mm/second) | Rotating speed of lower polishing plate (rpm) | Percent defective after polishing (%) |
|---|---|---|---|
| 7 | 5.0 | 1 | 0 |
| 8 | 5.0 | 4 | 0 |
| 9 | 10.0 | 4 | 0 |

Working Examples 10 and 11

Polishing was performed as follows on the substrate stocks of soda-lime glass (7-inch square and 3.0 mm in thickness) which are held in the work hole shown in FIG. 1. The upper polishing plate was brought into contact with the substrate stocks, while the lower polishing plate was rotating, under the conditions shown in Table 5. The substrate stocks had their surface coated with an impact-absorbing liquid, which is an aqueous solution containing ethylene glycol and triethanolamine in a ratio of 20:1 (by weight) such that it has a viscosity of 37 mPa·s at 20° C. The upper polishing plate in contact with the surface of the substrate stocks was rotated, with the interface between the substrate surface and the upper polishing plate being supplied with a slurry composed of pure water and zirconium oxide abrasive grains called "MZ-1000B," made by Daiichi Kigenso Kagaku Kogyo Co., Ltd. The substrate stocks underwent polishing in the same way as in Working Examples 1 to 6. The finished specimens were examined for flaws. The results of examination are shown in Table 5.

TABLE 5

| Working Example No. | Descending speed of upper polishing plate (mm/second) | Rotating speed of lower polishing plate (rpm) | Percent defective after polishing (%) |
|---|---|---|---|
| 10 | 7.0 | 1 | 0 |
| 11 | 7.0 | 4 | 0 |

Japanese Patent Application Nos. 2015-098267 and 2015-114759 are incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A method for producing substrates, comprising the steps of:

placing substrate stocks individually in work holes formed in a carrier on a lower polishing plate, bringing an upper polishing plate into contact with each of surfaces of said substrate stocks, each of the surfaces of said substrate stocks coated with an impact-absorbing liquid, while rotating said lower polishing plate, and polishing each of the surfaces of said substrate stocks by a polishing slurry, while rotating said upper and lower polishing plates, wherein said impact-absorbing liquid is an aqueous solution containing at least one species selected from glycols, polyacrylic acid and derivatives thereof, poly(meth) acrylic acid and derivatives thereof, diethanolamine, and triethanolamine.

2. The method for producing substrates of claim 1, wherein said upper polishing plate is brought into contact with each of the surfaces of said substrate stocks, with said lower polishing plate rotating at 1 rpm to 4 rpm.

3. The method for producing substrates of claim 1, wherein said impact-absorbing liquid has a viscosity of 10 mPa·s to 100 mPa·s at 20° C.

4. The method for producing substrates of claim 1, wherein said upper polishing plate is moved to the surface of substrate stocks until said upper polishing plate comes into contact with the each of the surfaces of substrate stocks at speed of 5 mm/second or more and 20 mm/second or less.

5. The method for producing substrates of claim 1, wherein said polishing slurry is an aqueous dispersion containing at least one species of abrasive grains selected from the group consisting of alumina abrasive grains, silicon carbide abrasive grains, and zirconium oxide abrasive gains.

6. The method for producing substrates of claim 1, wherein said substrate stocks have a thickness of 0.1 mm to 7 mm before polishing.

7. The method for producing substrates of claim 1, wherein said substrate stocks are synthetic quartz glass.

8. The method for producing substrates of claim 1, wherein said polishing step corresponds to a lapping step.

9. A method for producing substrates, comprising the steps of:

placing substrate stocks individually in work holes formed in a carrier on a lower polishing plate, bringing an upper polishing plate into contact with each of surfaces of said substrate stocks, each of the surfaces of said substrate stocks coated with an impact-absorbing liquid, while rotating said lower polishing plate, and polishing each of the surfaces of said substrate stocks by a polishing slurry, while rotating said upper and lower polishing plates, wherein said impact-absorbing liquid has a viscosity of 10 mPa·s to 100 mPa·s at 20° C.

10. The method for producing substrates of claim 9, wherein said upper polishing plate is brought into contact with each of the surfaces of said substrate stocks, with said lower polishing plate rotating at 1 rpm to 4 rpm.

11. The method for producing substrates of claim 9, wherein said upper polishing plate is moved to the surface of substrate stocks until said upper polishing plate comes into contact with the each of the surfaces of substrate stocks at speed of 5 mm/second or more and 20 mm/second or less.

12. The method for producing substrates of claim 9, wherein said polishing slurry is an aqueous dispersion containing at least one species of abrasive grains selected from the group consisting of alumina abrasive grains, silicon carbide abrasive grains, and zirconium oxide abrasive gains.

13. The method for producing substrates of claim 9, wherein said substrate stocks have a thickness of 0.1 mm to 7 mm before polishing.

14. The method for producing substrates of claim 9, wherein said substrate stocks are synthetic quartz glass.

15. The method for producing substrates of claim 9, wherein said polishing step corresponds to a lapping step.

* * * * *